United States Patent [19]

Wiedemann

[11] 4,446,591

[45] May 8, 1984

[54] VEHICLE FOR CLEARING MATERIAL FROM DRAINS AND THE LIKE

[76] Inventor: Karl Wiedemann, Haldenloh 2 a, 8901 Welden, Fed. Rep. of Germany

[21] Appl. No.: 371,177

[22] Filed: Apr. 23, 1982

[51] Int. Cl.[3] ..... B08B 3/02; B08B 9/04

[52] U.S. Cl. ..... 15/315; 15/302

[58] Field of Search ..... 15/302, 315, 323; 134/167 C, 168 R, 168 C

[56] References Cited

U.S. PATENT DOCUMENTS

| | | | |
|---|---|---|---|
| 2,595,655 | 5/1952 | Hannay | 15/315 X |
| 3,401,420 | 9/1968 | Lofgren | 15/323 |
| 4,134,174 | 1/1979 | Flynn et al. | 15/302 |
| 4,199,837 | 4/1980 | Fisco | 15/302 |
| 4,207,647 | 6/1980 | Masters | 15/302 |
| 4,244,079 | 1/1981 | Bane | 15/321 |

*Primary Examiner*—Chris K. Moore

*Attorney, Agent, or Firm*—Collard, Roe & Galgano

[57] ABSTRACT

A vehicle for cleaning drains or cesspools has a tank for taking up and transporting waste material such as sludge, an aspiration pipe and a reel for the pipe. The reel is so placed that, at least when aspiration is taking place, its axis is upright, this making possible the use of a single-piece aspiration pipe which only has to be uncoiled from the reel to the degree necessary to get the inlet end of the pipe to the point at which it is needed within the cesspool or the like.

10 Claims, 3 Drawing Figures

VEHICLE FOR CLEARING MATERIAL FROM DRAINS AND THE LIKE

BACKGROUND OF THE INVENTION

The present invention is with respect to a tank vehicle for taking up and transporting waste material such as sludge, having a reel for a flexible aspiration or suction pipe which, when aspiration is being undertaken, is joined up with the tank of the vehicle.

In a known vehicle on these lines the reel for the aspiration pipe is placed so that its axis is horizontal and lined up generally with the length direction of the vehicle, that is to say it is fixed to the vehicle chassis or the tank thereon so that the coils of the pipe are in upright planes. However, it has now been seen from experience that the operation of such a vehicle only gives the desired effect when the aspiration pipe is completely uncoiled from the reel when aspiration is undertaken. It is thought that the reason for this is that the degree of vacuum in the coils goes up to such a high level as the waste material is moving through the pipe that there is a separation of the column of waste of the tops of the coils. Completely uncoiling the pipe and then coiling it up on the reel on each cleaning operation makes the use of such a tank vehicle troublesome and slow so that, in the prior art, such reels have not been used. In general use, in fact, such undesired effects are still taken care of by joining together a number of short pieces of pipe to get the desired length of aspiration pipe. However, to do this, two workers will generally be needed so that this system as well has a high manpower need.

GENERAL OUTLINE OF THE INVENTION

Taking such prior art as a starting point, one purpose of the present invention is that of making such a better, but nevertheless simple, design of a tank vehicle of the sort noted that a single-piece aspiration pipe may be used designed to be coiled up on a reel and which only has to be uncoiled therefrom to a degree necessary to get the inlet end of the pipe to the point at which aspiration is to take place.

For effecting this purpose and further purposes a surprisingly simple design may be used in the present invention which is different to the prior art inasfar as, at least on aspiration of waste material, the reel is placed so that its axis is upright and the coils thereon horizontal.

As has become clear from testing, the aspiration pipe, even if not completely uncoiled and run off the reel, may be completely cleared of material at the end of the aspiration operation, something which is important on taking up poisonous materials or for insuring that no mixing occurs between two sorts of materials which might be the cause of an explosive reaction. The design of the present invention will, for this reason, be seen to give the useful effect of cutting down the manpower needed, making the work simpler, this being because it is no longer necessary for a number of short pipe lengths to be joined up together, while on the other hand it is not necessary for the aspiration hose to be completely uncoiled and then coiled up again for each aspiration operation.

In a first, specially useful form of the invention, the reel may simply be supported so that it may be folded, for example through 90°, between a transport position in which little space is needed and in which the axis is horizontal, and an aspiration, ready-for-use position with the reel sticking out from the rest of the vehicle so that its axis is upright. As a useful further development of such a system, the selection of the system for foldingly supporting the reel may be such that adjustment of the reel angle may be made to take into account the fact that the ground on which the tank vehicle is used may not be level. Putting it differently, such an adjustment system is used for levelling the reel. For most purposes, however, the design will only have to be such that the reel may be folded into two end positions, in which the reel is rested against stops with a 90° angle therebetween.

As part of a further useful development of the invention, the reel may be folded by an actuator acting on the reel itself or through a driving system so that there is less work for the person(s) manning the vehicle.

As part of a specially simple further development of the invention, the reel may be supported on top of the tank with its axis upright, one end of the aspiration pipe being joined up by way of a turning union and an inlet pipe opening into the tank. Furthermore, a boom may be placed next to the reel for guiding the aspiration pipe by way of rollers, on which the pipe may be supported, without damage.

For making operation of the vehicle even simpler, a motor may be used for turning the reel on coiling up and uncoiling the aspiration pipe thereon.

LIST OF FIGURES AND DETAILED ACCOUNT OF TWO WORKING EXAMPLES OF THE INVENTION

Further useful effects and developments of the invention will be seen from the account now to be given of two working examples, to be seen in the figures, and the claims.

Figure 1:
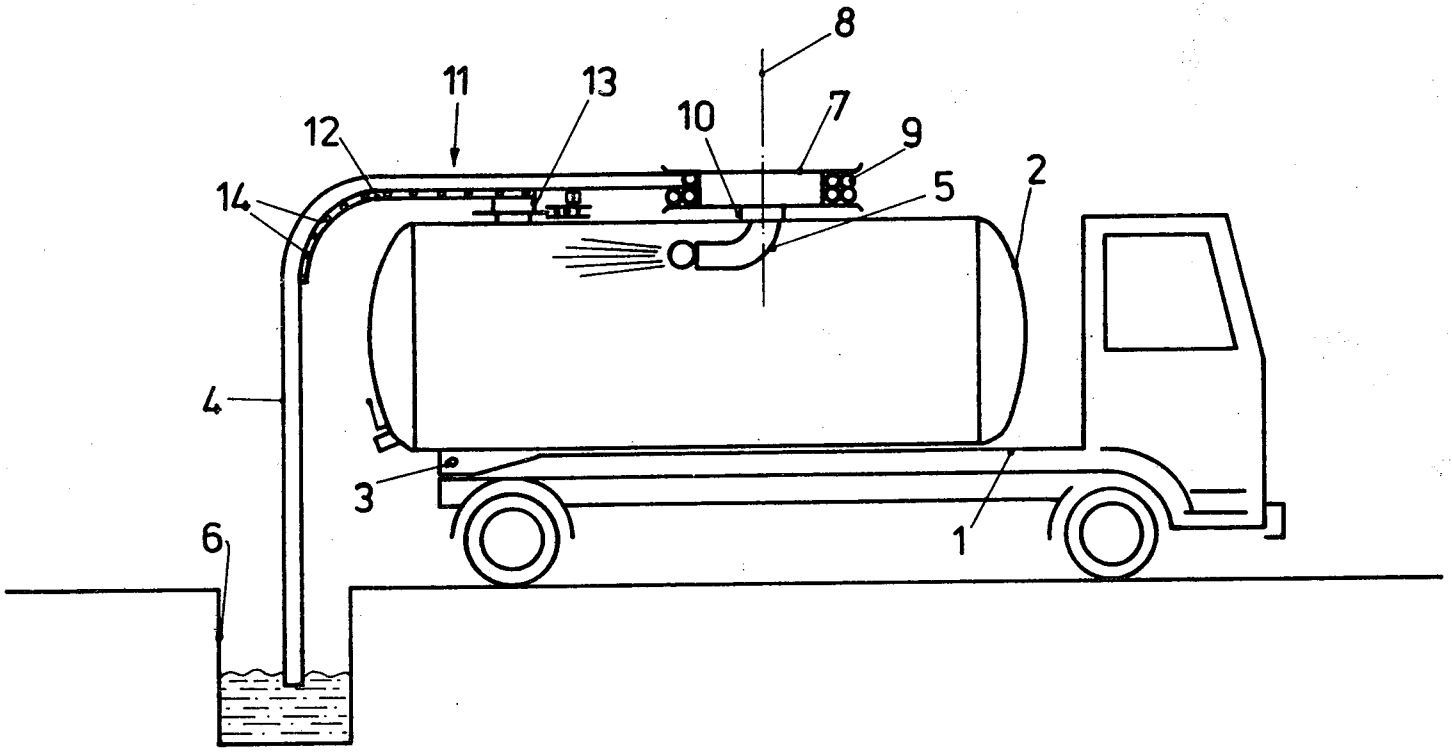
FIG. 1 is a diagrammatic side view of a tank vehicle of the present invention with a reel placed on top of the tank.

The vehicle to be seen in FIG. 1 has a vehicle chassis 1 on which a tank 2 is supported so that it may be turned about a shaft 3 at the back of the vehicle. For taking up sludge or like waste by aspiration, a flexible aspiration pipe 4 is used. The special design and workings of vehicles on these lines are well known so that no detailed account thereof has to be given at this point. The aspiration pipe 4 is joined up with an inlet pipe 5, opening into tank 2. For such aspiration operation it is normal for the tank 2 to be evacuated by a vacuum pump, not shown. In systems using a sludge pump for pumping the sludge into the tank 2, the aspiration pipe is naturally joined up with the inlet side of such pump, whose outlet side will then be joined up with the tank 2.

The aspiration pipe 4 to be lowered into the cesspool, designated 6, to be emptied is long and is made in a single length. For supporting this single-piece aspiration pipe, a reel 7 is placed on top of the tank with its axis 8 upright so that the turns 9 of the aspiration pipe are horizontal and aspiration may take place through the pipe 4 without any trouble, that is to say, all material may be cleared from the pipe at the end of a cleaning operation, even although the pipe has not been completely run off the reel 7. The diameter of the reel may be large so that the axial length of the reel may be small and the reel is in fact low in height. The end, not shown in FIG. 1, of the last turn 9 of the aspiration pipe 4 may be simply joined up with the inlet pipe 5, running into the tank, by way of a turning union or swivel, not shown in the figure. For adjustment of the reel to make certain that the axis 8 thereof is truly upright, even if the vehicle is not on level ground, the reel 7 may be placed so that it may be levelled in relation to the vehicle chassis 1 or the tank 2 placed thereon. In the present working example the lower part 10 of the turning union is simply fixed to the tank 2, this being all that is needed in most cases, because even if the turns are at a small angle to the horizontal, it is nevertheless possible for all material to be cleared therefrom.

Next to the reel 7 there is a boom generally numbered 11 having an arm 12 and a turning ring 13. Boom arm 12 has rollers 14 so that the aspiration pipe 4 may be run off the reel and taken up again without damage. Because the aspiration pipe 4 is simply run off from reel 7 on lowering the pipe into a cesspool to be emptied or into a drain or sewer to be cleaned or the like, it is not necessary for the boom arm 12 to be moved upwards and downwards, this making the boom design simpler. The reel 7 may be turned by a motor (not shown) on letting off and taking up the aspiration pipe 4.

Figure 2:
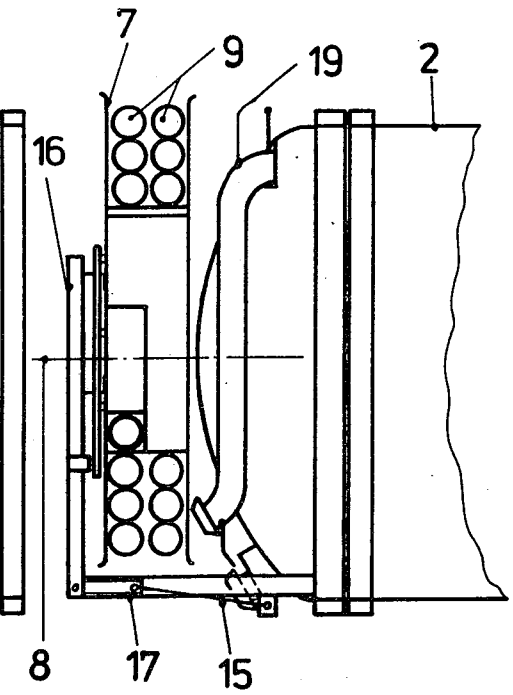
FIG. 2 is a view of part of a further vehicle of the present invention at its back end with the rocking reel folded up into the transport position.
Figure 3:
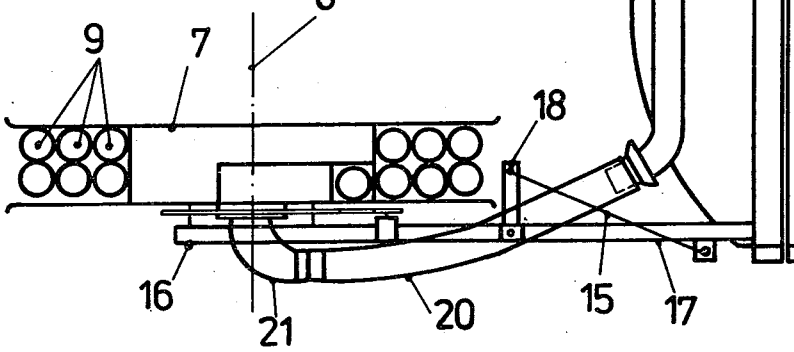
FIG. 3 is a view of the system of FIG. 2 with the reel folded down into the aspiration position.

In the case of the working example to be seen in FIGS. 2 and 3, the reel 7 for the aspiration pipe 4 is placed at the back end of the tank 2 supported on the vehicle's chassis. In the transport position to be seen in FIG. 2, the axis 8 of reel 7 is generally lined up with the length direction of the vehicle so that the vehicle is hardly made any longer by having the reel 7, such reel being as it is of narrow design. The reel 7 is able to be pivoted out of the transport position to be seen in FIG. 2 into the aspiration position of FIG. 3, in which the axis 8 of the reel 7 is generally upright and the coils 9 of the aspiration pipe are generally horizontal so that there is no danger of separation of the column of material in the pipe on aspiration and the pipe may be readily completely cleared of material. For pivoting the reel 7 between its two positions, use is best made of an actuator 15 acting on the reel itself or on a driving system. In the working example to be seen in the figures, the reel 7 is supported on a pivot arm 16 turningly supported on a support part 17 fixed to the vehicle's chassis or the tank 2 thereon. In the present working example, the reel 7 is placed over the support part 17 in the transport position so that the reel 7 is kept in its folded-down position for aspiration simply by a stop taking up the weight of the reel. The pivot arm 16 and the support part 17 may simply be made up of frames made from girder material. The pivot arm 16 has a leg 18 normal thereto, the actuator 15 acting against the leg while the other end of the actuator is turningly joined with the vehicle's chassis or on the support part 17 fixed thereto.

For most purposes it is only necessary for the design to be such that the reel 7 may be turned through 90° out of the transport position to be seen in FIG. 2 into the aspiration position to be seen in FIG. 2. For unloading the actuator 15 in the aspiration position, it is possible to have a stop for taking up the weight of the reel while for unloading the actuator in the transport position it is possible to have a bolt for locking the reel in the upright position, there furthermore being a stop at about 90° from the first-noted stop. The reel 7 may furthermore have a system for turning it in one, or in one or other direction.

For connection of the end of the aspiration pipe fixed to the reel there is a short inbetween piece 20 in the present working example which is joined up with the aspiration connection of the tank 2. The inbetween piece 20 is joined up at its other end with the connection 21 forming part of a turning union or joint running through the bearing of the reel. If the inbetween piece 20 is flexible enough, it may be permanently joined to the reel 7; in the present working example, however, the inbetween piece 20 is taken off when the reel is moved into the transport position.

Although an account has only been given of two working examples of the invention, this is not to have the effect of limiting the general idea of the invention. A number of different changes are possible in the working examples, such as for example having the reel 7 fixed to one side of the vehicle.

I claim:

1. A tank vehicle for cleaning drains and cesspools by aspiration, having a tank, a reel, a flexible pipe designed to be coiled up on said reel, said pipe being joined with said vehicle's tank for aspiration, said reel having, at least during an aspiration operation, an upright axis with said pipe placed in horizontal turns about it.

2. The tank vehicle as claimed in claim 1, wherein said reel is supported so that it may be pivoted.

3. The tank vehicle as claimed in claim 2, having a system for adjustment of the angle of said axis to the horizontal to keep said axis truly upright even when the tank vehicle is on ground which is not completely level.

4. The tank vehicle as claimed in claim 2 having a pivot arm for supporting said reel, and a support part, connected to said vehicle's chassis, for supporting said pivot arm.

5. The tank vehicle as claimed in claim 4, in which said pivot arm has two defined end positions with an angle of 90° therebetween.

6. The tank vehicle as claimed in claim 2 or claim 3, in which the reel is placed at a back end of said vehicle and may be pivoted from one position in which the reel's axis is lined up with the length direction of the vehicle and a lowered position for aspiration in which the reel's axis is upright.

7. The tank vehicle as claimed in claim 2 or claim 3 having an actuator for pivoting the reel.

8. The tank vehicle as claimed in claim 1, wherein said reel is placed on the tank of the vehicle with its axis upright.

9. The tank vehicle as claimed in claim 8 having a boom for guiding the aspiration pipe, said boom having an arm with rollers for supporting said aspiration pipe.

10. The tank vehicle as claimed in claim 1, claim 2 or claim 3, having a motor for coiling up and uncoiling the aspiration pipe on the reel.

* * * * *